US006738988B2

(12) United States Patent
Ruiter et al.

(10) Patent No.: US 6,738,988 B2
(45) Date of Patent: May 25, 2004

(54) THONG-TYPE GARMENT WITH WIREFRAME CONSTRUCTION

(76) Inventors: Edward T. Ruiter, 488 Castor Street, Russell (CA), K4R 1E5; Jacqueline Dugas-Ruiter, 488 Castor Street, Russell (CA), K4R 1E5

( * ) Notice: Subject to any disclaimer, the term of this patent is extended or adjusted under 35 U.S.C. 154(b) by 80 days.

(21) Appl. No.: 10/264,852

(22) Filed: Oct. 4, 2002

(65) Prior Publication Data

US 2004/0064872 A1 Apr. 8, 2004

(51) Int. Cl.[7] ..... A41B 9/00
(52) U.S. Cl. ..... 2/400; 2/67
(58) Field of Search ..... 2/400–408, 71–73, 2/228, 238, 46, 67, 69, 255–264, 271, 78.1–78.4, 243.1, 105, 211, 47, 48, 212, 213, 216; 602/60, 61, 67, 69, 70; 450/99, 100, 107, 151, 153, 156; D2/700, 711–714, 731, 738, 728, 735–737, 851, 852, 860, 861

(56) References Cited

U.S. PATENT DOCUMENTS 2,534,934 A * 12/1950 Viniegra ..... 2/400
3,339,208 A * 9/1967 Marbach ..... 2/67
3,774,241 A * 11/1973 Zerkle ..... 2/67
4,394,781 A * 7/1983 Axmann ..... 2/67
5,347,657 A * 9/1994 Unsell ..... 2/67
5,367,715 A * 11/1994 Leonard et al. ..... 2/401
5,396,662 A * 3/1995 Leonard et al. ..... 2/401
5,467,482 A * 11/1995 Crawford, II ..... 2/67
5,832,535 A * 11/1998 Davis ..... 2/1
6,490,732 B1 * 12/2002 Spoke ..... 2/67

* cited by examiner

*Primary Examiner*—Gloria M. Hale
(74) *Attorney, Agent, or Firm*—McHale & Slavin, P.A.

(57) ABSTRACT

An open-sided thong-type brief garment having a resilient wire frame including an anterior frame portion and a posterior frame portion which curve inwardly towards one another in a spring-biased arrangement. The anterior frame portion configured in a symmetrical U-shape and is adapted to curve around the genital region of the wearer in tensioned engagement. The anterior frame portion has an arcuate base and two upwardly extending stems terminating in closed loops. The posterior frame portion is attached to the arcuate base and is configured to curve upwardly between the buttocks of the wearer. The posterior frame portion terminates in a closed loop adapted for tensioned engagement with the sacrum of the wearer. The garment includes a fabric covering on the frame which includes a substantially triangular-shaped front fabric panel which spans the anterior frame portion to conceal the groin area of the wearer. Elastic is sewn into the perimeter of the front fabric panel to maintain snug contact with body of the wearer. In an alternative embodiment of the invention, the front fabric panel has opposing side edges formed as casings which have elastic belts disposed therein which can be extended out of the casings to encircle the waist of a wearer.

17 Claims, 6 Drawing Sheets

THONG-TYPE GARMENT WITH WIREFRAME CONSTRUCTION

FIELD OF THE INVENTION

This invention relates generally to the field of brief-type garments for men and women, and more particularly to an open-sided, waistless thong-type garment which is undetectable under form-fitting clothing.

BACKGROUND OF THE INVENTION

A problem encountered when wearing tight, form-fitting clothing, such as Spandex©, is that the wearer's undergarments tend to show through creating distracting lines in the clothing. This is especially a problem for professional dancers wearing form-fitting garments who need to have a neat appearance, without visible undergarment lines, while still maintaining an adequate degree of coverage.

Brief-type garments for the lower body are typically constructed to have a waist-encircling elastic portion. In order to eliminate this elastic waistband, the present invention as disclosed herein contemplates a side-less, self-supporting thong-type brief utilizing a small diameter resilient wire frame which is suitable for use as an undergarment, a swimsuit, or a tanning garment. Thong-type bikinis or briefs formed from resilient wire are known in the art. Examples include Marbach, U.S. Pat. No. 3,339,208, Leonard et al., U.S. Pat. Nos. 5,367,715 and 5,396,662, Crawford, U.S. Pat. No. 5,467,482 and Viniegra, U.S. Pat. No. 2,534,934.

U. S. Pat. No. 3,339,208 discloses a contoured loop of resilient steel wire which forms a spring adapted to be placed between the wearer's legs in order to provide a minimal clothing article for the lower portion of the human figure which does not require any body circling element. The garment is made of a spring designed to fit between the legs of the wearer with a suitable flexible covering applied to the spring.

U.S. Pat. No. 5,467,482 discloses a thong-type tanning brief having an interior frame formed of a length of resilient malleable wire which has no side or waist portions. The brief is packaged and sold in a straight configuration, and is thereafter curved along its length to custom fit the body of the wearer.

U.S. Pat. Nos. 5,367,715 and 5,396,662 similarly disclose a wire frame for a bikini bottom having a V-shaped front portion and a T-shaped rear portion. The frame is constructed from two lengths of wire which are bent to define mirror images of each other.

Each of the above-described garments would not be suitable as an undergarment for form-fitting clothing because the shape and thickness of the articles would make them clearly visible beneath the wearer's clothing. These prior art garments would therefore not meet the objectives of the present invention.

U.S. Pat. No. 2,534,934 discloses a support or shield garment designed for male wearers which is constructed from a one piece wire frame which is covered with fabric. The device is maintained in place by engaging with portions of the male anatomy. This support garment is designed for male wearer's only, and would not be especially suitable to be worn alone as a swimsuit.

Another drawback of each of the prior art garments is that they include a wire portion generally aligned with the waist of the wearer which forms the upper portion of the wire triangle which covers the pubic region. This construction would make the garment difficult to wear during some physical activities, such as dancing or swimming, because the inflexibility of the wire portion may cause the entire garment to buckle outwards. In order to maintain the garments in place without gaping away from the body during physical activities, they would have to fit extremely tightly on the body. They would therefore be overly restrictive and uncomfortable.

Yet another disadvantage of the prior art garments is that the wire portions forming the front part of the garments extend under the legs of the wearer in a narrow V- or Y-configuration. Movement of the wearer's legs would cause the wires to pinch together, which is highly undesirable.

There remains a need for a thong-type garment which is largely invisible when worn wear under tight clothing, which is comfortable for the wearer, and which readily conforms to the body of the wearer.

SUMMARY OF THE INVENTION

It is an objective of the invention to provide an open-sided, waistless thong-type garment having a spring wire frame which is undetectable under form-fitting clothing.

It is another objective to provide an open-sided, waistless thong-type garment which conforms to the body so it can be comfortably worn.

It is still another objective to provide an open-sided, waistless thong-type garment which is suitable for use as an undergarment, a swimsuit, or a tanning garment.

It is a further objective of the invention to provide an open-sided, waistless thong-type garment which includes a retractable belt which encircles the waist when more secure wear is desired, and which also allows the attachment of a skirt to the belt for greater coverage and versatility of wear.

It is yet a further objective of the invention to provide an open-sided, waistless thong-type garment which has a unitary wire portion extending between the legs of the wearer.

It is still a further objective of the invention to provide an open-sided, waistless thong-type garment which has a wire frame having extensions in a floating construction so that the garment easily accommodates the movement of the body.

It is still a further objective of the invention to provide an open-sided, waistless thong-type garment which can be worn by both men and women.

In accordance with the above objectives, an open-sided thong-type garment is provided which has a frame constructed from a resilient wire such as piano wire or steel spring wire. The frame has an anterior frame portion and a posterior frame which curve inwardly towards one another in a spring-biased arrangement. The anterior frame portion configured in a symmetrical U-shape and is adapted to curve around the genital region of the wearer. The anterior frame portion has an arcuate base and two upwardly extending stems terminating in closed loops. The posterior frame portion is attached to the arcuate base and is configured to curve upwardly between the buttocks of the wearer. The posterior frame portion terminates in a closed loop adapted for tensioned engagement with the sacrum of the wearer. The garment includes a fabric covering on the frame which includes a substantially triangular-shaped front fabric panel which spans the anterior frame portion to conceal the groin area of the wearer. Elastic is sewn into the perimeter of the front fabric panel to maintain snug contact with body of the wearer.

In another embodiment of the invention, the front fabric panel has left and right side edges which are formed as casings which have elastic belts disposed therein. The retractable belts have a first end secured at a point inside the casings and a second end extendable outside the casing. The belts can extend around the waist of the wearer. The second ends of the belts include mated fasteners which allow the belts to be securely attached to one another. A skirt or similar garment can be hung from the belt when greater coverage is desired.

In another embodiment of the invention, a horizontal bar is removably attached to the posterior frame portion of the frame such that the horizontal bar is in tensioned engagement with the lower back of the wearer. The garment further includes a substantially triangular-shaped rear fabric panel formed as a pocket which has a closed upper edge which is fitted over the horizontal bar and posterior frame portion and an open lower edge which can be attached to the front fabric panel. The front fabric panel and rear fabric panel are secured to one another using mated fasteners.

In another aspect of the invention, the garment can include apertures coincident with the loops in the frame so that ornaments can be removably attached to the loops to position the ornaments against the skin of said wearer.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
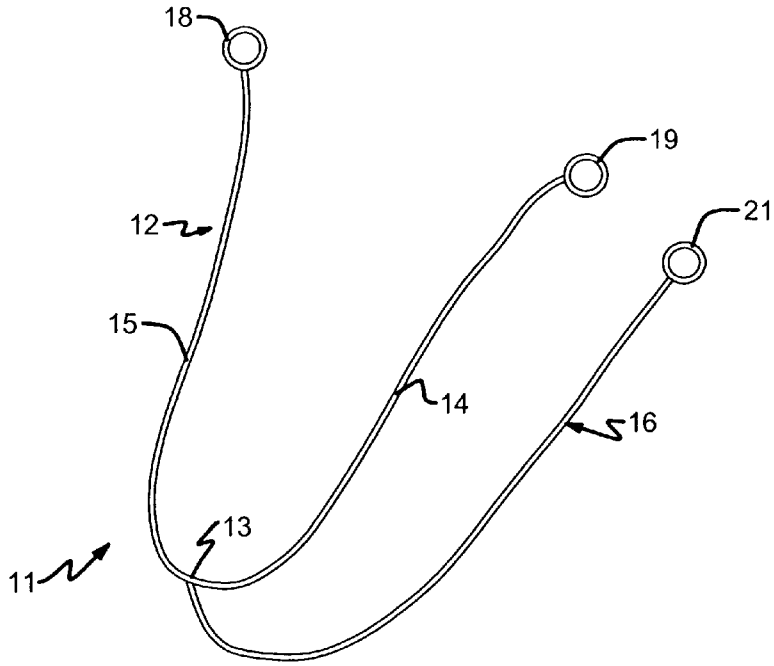
FIG. 1 is a perspective view of the wire frame of the garment of the preferred embodiment.
Figure 2:
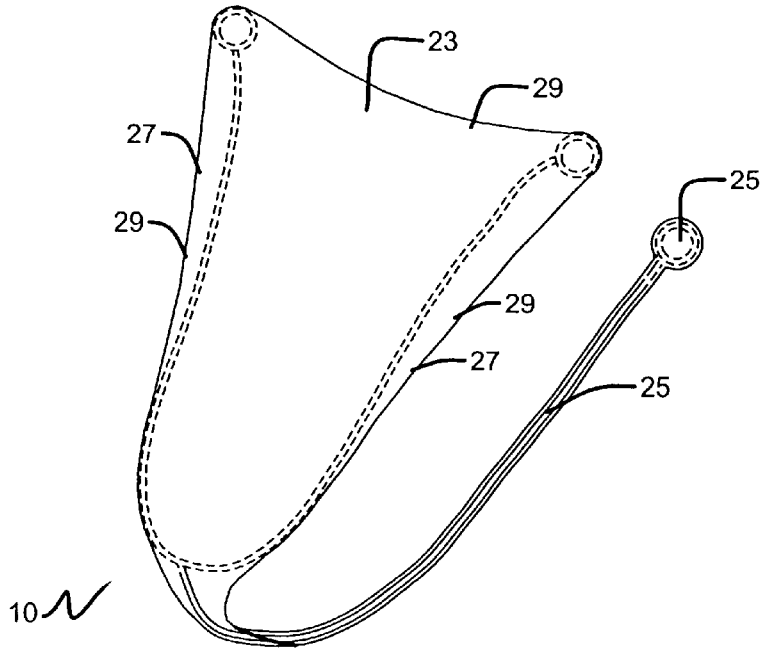
FIG. 2 is a perspective view of the garment of the preferred embodiment.
Figure 3:
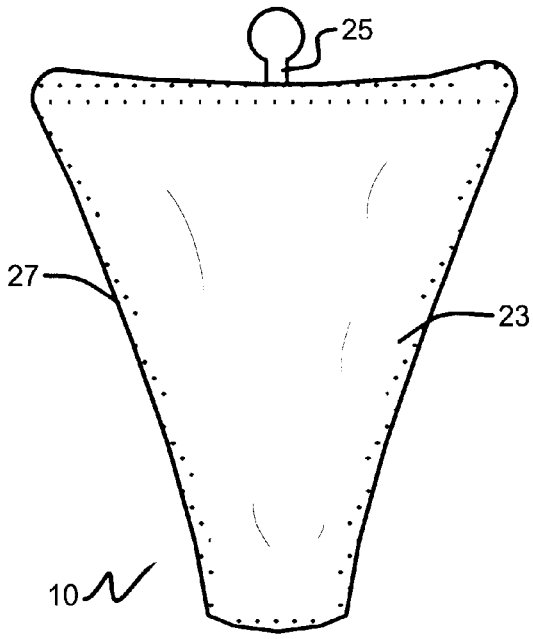
FIG. 3 is a front elevational view of the garment of FIG. 2.
Figure 4:
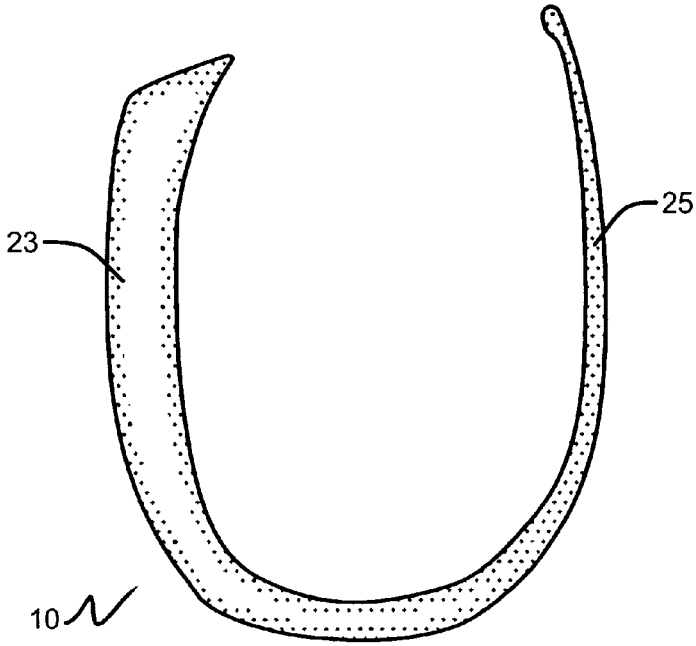
FIG. 4 is a side elevation view of the garment of FIG. 2, the opposite side being substantially a mirror image thereof.

In FIG. 1 is illustrated the wire frame 11 which forms the basis of the preferred embodiment of the garment 10 shown in FIGS. 2–4. The garment 10 of the present invention is an open-sided thong-type brief suitable for use by both men and women as an undergarment, a tanning garment, or as swimwear. When worn, the garment 10 covers the crotch area and curves upwardly between the buttocks of the wearer. The garment 10 is waistless and side-less, and is maintained on the body of the wearer by spring tension in the wire frame 11. The wire frame 11 is preferably constructed of a shape-retaining wire having high resiliency, such as stainless steel spring wire or piano wire. Stainless steel is preferable because it will not be affected by moisture that would be introduced by perspiration, laundering, or swimming. The frame 11 includes an anterior frame portion 12 and a posterior frame 16 portion which curve inwardly towards one another in a spring-biased arrangement. The anterior frame portion is configured in a symmetrical U-shape and is adapted to surround the genital region of the wearer and engage closely with the body. The anterior frame portion has an arcuate base 13 and two upwardly extending stems 14, 15. The stems 14, 15 terminate in closed loops 18, 19 for the comfort of the wearer, and to protect the wearer's clothing. The posterior frame portion 16 is attached to the anterior portion 12 at the base 13. The upward curve of the posterior frame portion 16 allows the posterior frame portion 16 be positioned between the buttocks of the wearer. The posterior frame portion 16 terminates in a closed loop 21 which is adapted for tensioned engagement with the sacrum of the wearer.

As shown in FIG. 2, a fabric covering is fitted over the frame 11 to form the garment 10. A substantially triangular-shaped front fabric panel 23 spans the anterior frame portion 12. In the preferred embodiment, the front fabric panel 23 extends outwardly beyond the anterior frame portion 12 to provide a greater degree of coverage of the wearer's groin area. The perimeter 27 of the front fabric panel 23 can include elastic means 29 to ensure a snug fit against the body of the wearer. The posterior frame 16 is covered with posterior frame fabric 25 which is to contiguous to front fabric panel 23 so that the wire frame 11 is not exposed. FIGS. 3 and 4 respectively illustrate front and side views of the garment 10.

The inventive construction of the wire frame 11 provides many advantages over the prior art garments. The construction of the frame 11 ensures that the garment 10 is undetectable when worn under tight, form fitting clothing. Another advantage is that the U-shape of the anterior frame portion 12 molds around the pubic bone of the wearer, rather than crossing over it, to prevent pinching. Also, the juncture of the anterior frame portion 12 and the posterior frame portion 16 is toward the front of the body, which prevents uncomfortable constriction when the wearer is sitting. This provides a better fit and greater comfort for the wearer.

Another key feature of the garment of the present invention is that the anterior frame portion 12 has upwardly extending stems 14, 15 which have a "floating" construction, and not connected by an upper horizontal portion as seen in the prior art. This advantageously ensures that the garment will fit snugly against the body of the wearer because the stems 14 and 15 can move independently of each other without causing the central section to gape outwardly from the body. In this way, the garment 10 of the present invention provides a superior garment for active wear.

Figure 5:
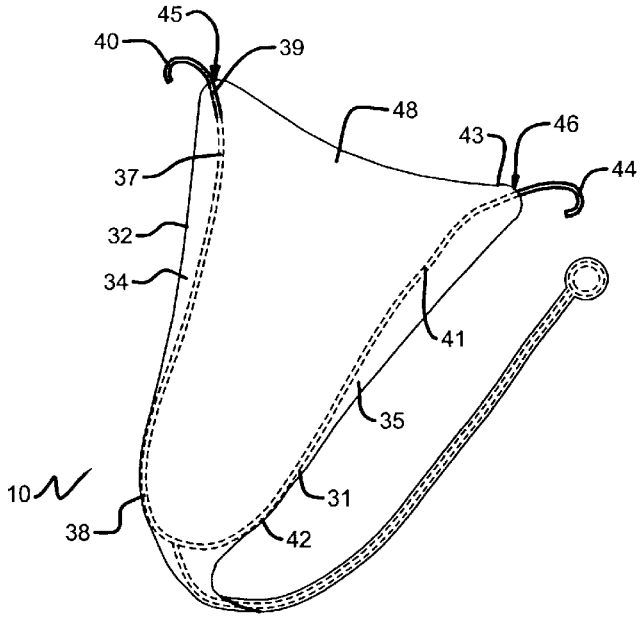
FIG. 5 illustrates an alternative embodiment of the invention which includes retractable elasticized belts disposed in casings in the front fabric panel.
Figure 6:
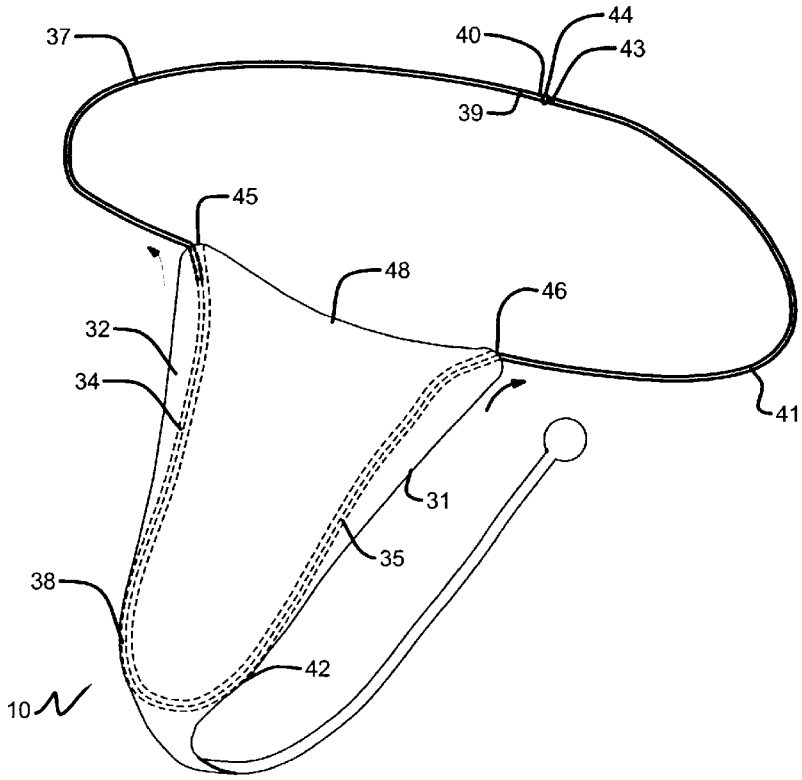
FIG. 6 illustrates the embodiment of FIG. 5 in which the belts are extended out of the casings so as to encircle the waist of a wearer.

A second embodiment of the garment 10 is illustrated in FIGS. 5 and 6. In this embodiment, the left and right side 31, 32 of the front fabric panel 23 include left and right elastic casings 34, 35 which are formed using any suitable means, and are preferably sewn into the front fabric panel 23. The elastic casings 34, 35 each have openings 45, 46 proximate the top edge 48 of the front fabric panel 23. Respectively disposed in the elastic casings 34, 35 are elasticized belts 37 and 41. The belts 37 and 41 each have lower ends 38 and 42 which are fixedly attached to the front fabric panel 23 at a point inside the elastic casings 34, 35. The upper ends 39 and 43 of the belts 37, 41 are extendable outside of the casings 34, 35, and respectively include mated fasteners 40 and 44. The elasticized belts 37 and 41 have sufficient elasticity to retract into the casings 34, 35 when not in use, but at the same time allows the belts 37, 41 to be extended outside the casings 34, 35 to a point where they encircle the waist of the wearer. The belts 37 and 41 can be fastened to one another by mated fasteners 40 and 44. The fasteners 40 and 44 are slightly larger in size than openings 45 and 46 so that the belts 37, 41 are not totally retracted and remain accessible. The elasticized belts 37 and 41 can be constructed from two different types of elastic so that the lower part of the belts 37, 41 is constructed from a more highly elastic material than the waist encircling parts to facilitate automatic retraction of the belts 37 and 41 into the casings 34, 35.

Figure 7:
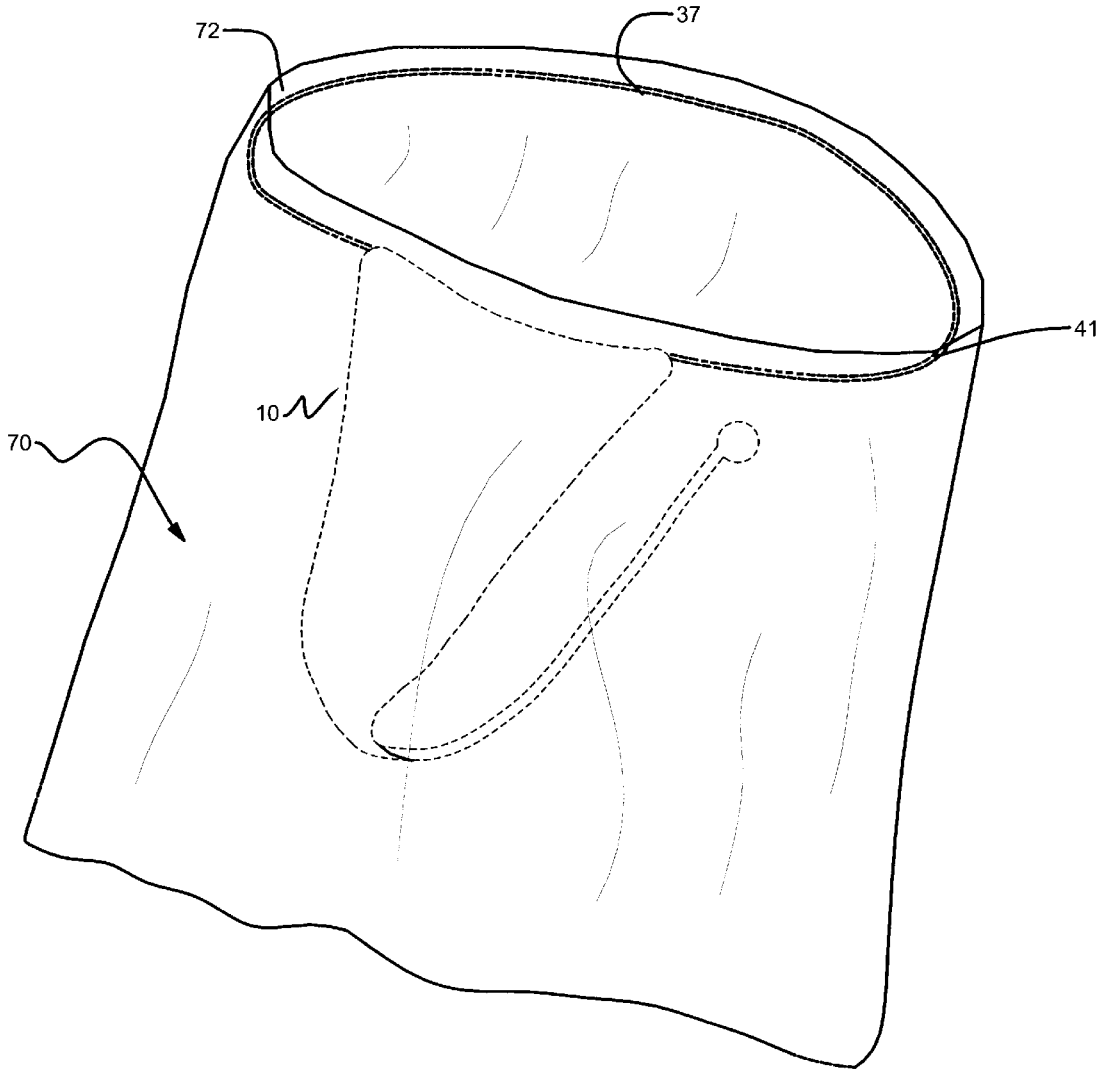
FIG. 7 illustrates the embodiment of FIG. 5 in which a skirt garment has been attached to the belts.

When the wearer desires that the garment 10 be secured to the body to a greater extent, the belts 37 and 41 can be extended and fastened to form an elasticized waistband. In another aspect of the invention illustrated in FIG. 7, a skirt garment 70 can be attached to the belts 37 and 41. The skirt garment 70 has a upper edge 72 adapted to fit around the waist of the wearer. The upper edge 72 includes an attachment means (not shown) which allows the upper edge 72 to be attached to the belts 37 and 41. Any suitable attachment means can be utilized. In the preferred embodiment, mated strips of hook and loop fastening material can be attached proximate the upper edge 72 which can be fastened around the belts 37 and 41. The skirt garment 70 can be quickly and easily added to the garment 10 by the wearer in situations where greater coverage may be desired. The skirt garment 70 can be constructed from fabric which is either identical to that of the fabric panels 23 and 25, or which visually coordinates with the fabric panels 23 and 25 from a standpoint of color, pattern and texture.

In an alternative arrangement to that shown in FIGS. 5 and 6, a casing can be formed along the top edge 49 of front panel 23 which has openings at the left and right side edges 31, 32. First and second elasticized belts having mated fasteners can be disposed within the casing, either at the center or at either end. The belts can be extended to encircle the waist of a wearer, and a skirt garment can be attached as described above.

Figure 8:
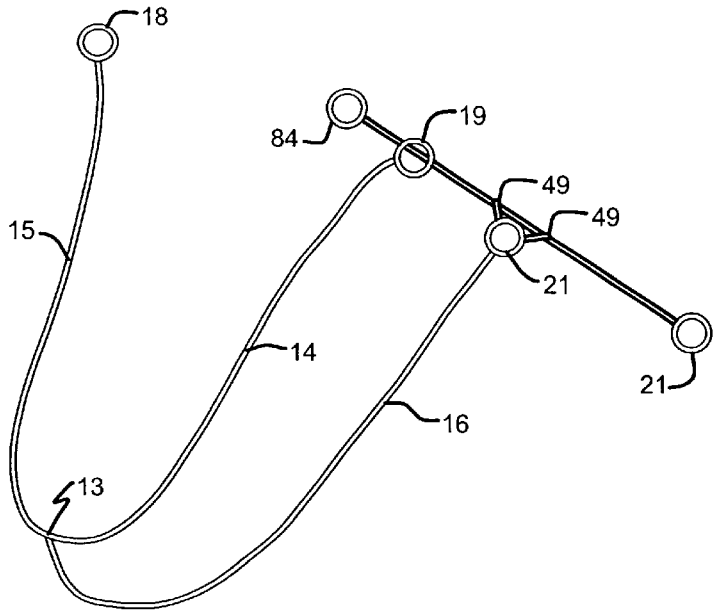
FIG. 8 illustrates a second alternative embodiment of the invention in which a horizontal bar is added to the frame to allow the addition of a rear fabric panel.
Figure 9:
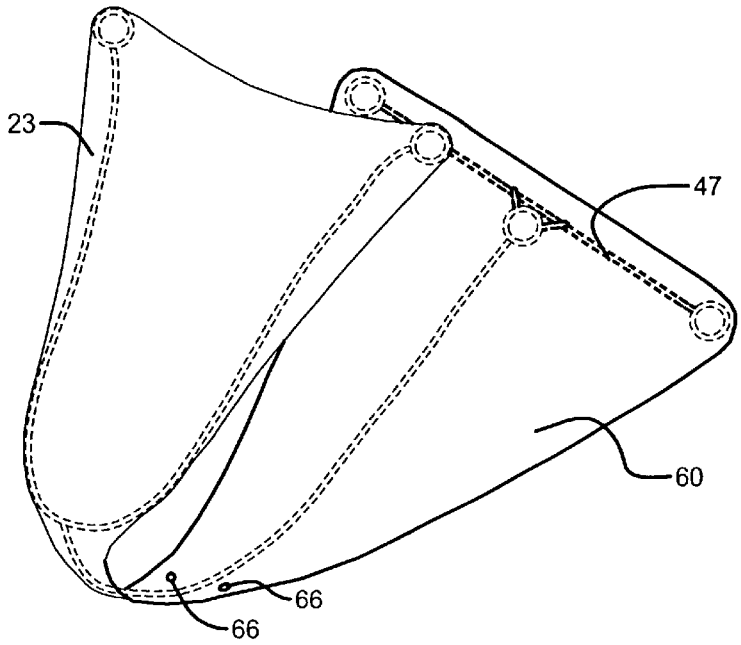
FIG. 9 illustrates the embodiment of FIG. 8 which includes the rear fabric panel.

A third embodiment of the invention is shown in FIG. 8, In this embodiment, the loop 21 of the posterior frame 16 includes an attachment means by which a horizontal bar 47 can be attached to the top of the loop 21. In the illustrated embodiment, the attachment is accomplished by elastic loops 49, however any suitable attachment means can be utilized which enables the horizontal bar 47 to be selectively inserted and removed. The horizontal bar 47 is configured to be in tensioned engagement with the lower back of the wearer. As shown in FIG. 9, the horizontal bar 47 cooperates with the posterior frame portion 16 to provide a frame for a generally triangular-shaped back fabric panel 60. The back fabric panel 60 can be constructed in any desired manner, and can, for example be formed as a pocket which is open at the lower edge. The front fabric panel 23 and the back fabric panel 60 include mated fasteners 66 which allow the fabric panels 23 and 60 to be attached to one another. The addition of the horizontal bar 47 allows the back fabric panel 60 to be added to the garment 10 when greater coverage is desired. The horizontal bar can include looped ends 84 and 85 to prevent damage to the back fabric panel 60.

Figure 10:
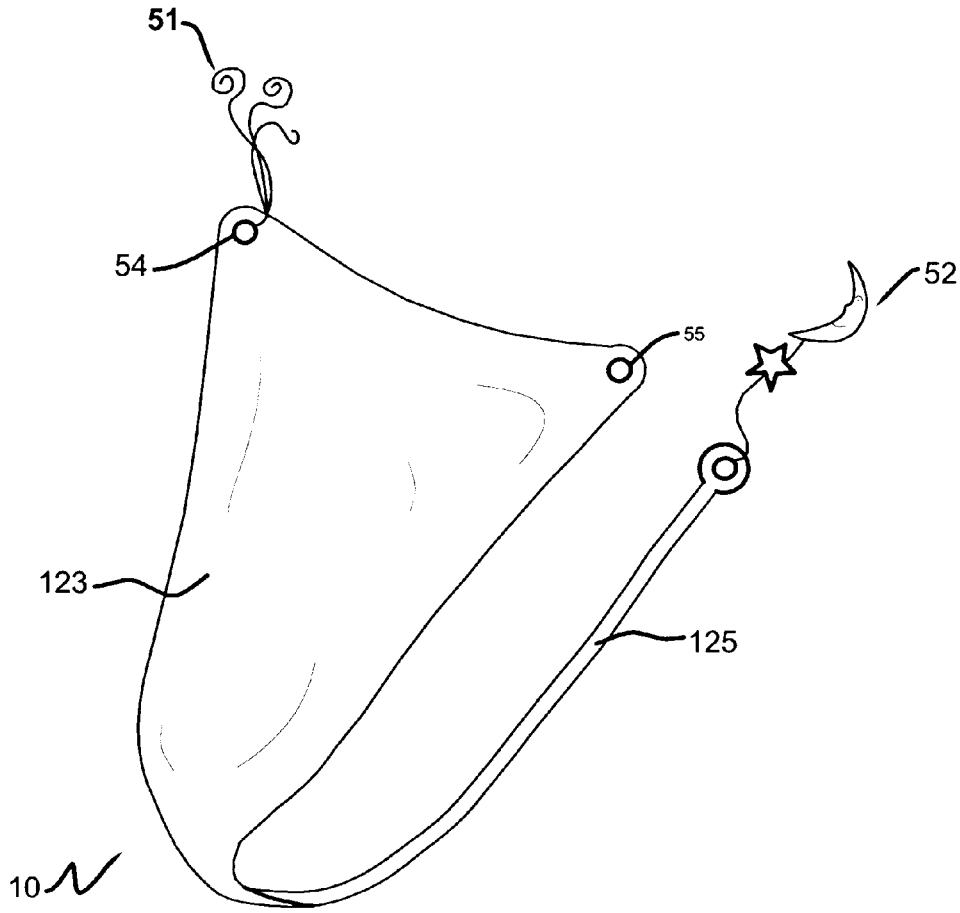
FIG. 10 illustrates a third alternative embodiment of the invention in which the garment includes apertures to allow the addition of ornaments to the garment.

Another embodiment of the invention is shown in FIG. 10. This embodiment incorporates the wire frame 11 depicted in FIG. 1. In the embodiment of FIG. 10, a front fabric panel 123 includes apertures 54, 55 which are coincident with the wire frame loops 18, 19 (visible in FIG. 1), and the posterior frame fabric 125 includes an aperture 57 coincident with loop 21 (visible in FIG. 1). These apertures allow accessories to be inserted through the loops 18, 19 and 21 of the wire frame 11 shown in FIG. 1. As shown in FIG. 10, so-called "sun tattoo" ornaments 51 and 52 can be attached to the garment 10. Commercial logos can also be incorporated in the garment 10 in this manner.

The wire frame 11 of the invention can be constructed in using any suitable means.

In the preferred embodiment, the anterior poriton 12 and the posterior frame portion 16 are formed separately and then welded together. In an alternative embodiment, the wire frame 11 is formed from two lengths of wire, one of which provides the posterior frame portion 16 and one stem of the anterior portion 12, and the other providing the opposite stem of anterior portion 12. The wire frame 11 can also be constructed from three separate/lengths of wire which are welded together. The loops 18, 19, and 21 are preferably welded closed so that there are no sharp edges which may injure the skin or snag clothing. The garment 10 can be manufactured in standard pre-formed sizes. The garment 10 can also be custom fit for an individual by first providing a template wire frame formed from a highly malleable wire which can be formed to the wearer's body. A frame 11 from spring wire or piano wire can then be constructed based on the template frame.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. An open-sided thong-type brief garment; comprising:

a frame constructed from resilient wire, said frame having an anterior frame portion and a posterior frame portion each formed from a single segment of wire wherein said anterior frame portion and posterior frame portion curve inwardly towards one another in a spring-biased arrangement;

said anterior frame portion configured in a symmetrical U-shape wherein said anterior portion is adapted to encompass the genital region of the wearer in tensioned engagement, said anterior frame portion having an arcuate base and two upwardly extending stems terminating in closed loops;

said posterior frame portion being attached to said arcuate base and configured to curve upwardly between the buttocks of the wearer, said posterior frame portion terminating in a closed loop adapted for tensioned engagement with the sacrum of the wearer; and a fabric covering on said frame, wherein said fabric covering includes a substantially triangular-shaped front fabric panel spanning said anterior frame portion whereby the groin area of the wearer is concealed.

2. The garment of claim 1, wherein said triangular-shaped front fabric panel has a perimeter, and further includes elastic sewn into said perimeter.

3. The garment of claim 1, wherein said triangular-shaped panel has left and right side edges which are each formed as a casing having an inside accessible through first and second openings , and each of said casings respectively include retractable elastic belts disposed therein, wherein said retractable belts each have a first end secured to said inside of said casing and a second end extendable outside the casing through one of said openings, wherein said second ends include mated fasteners wherein said belts can be fastened to one another whereby the belts can encircle the waist of a wearer.

4. The garment of claim 3, further comprising a skirt garment having an upper edge adapted to fit on the waist of a wearer, said upper edge including an attachment means wherein said upper edge can be attached to said belts when said belts are fastened to one another.

5. The garment of claim 4, wherein said attachment means comprises mated strips of hook and loop fastening material.

6. The garment of claim 1, wherein said frame further comprises a horizontal bar extending outward from said posterior frame portion which is configured to be in tensioned engagement with the lower back of the wearer, and said garment further includes a substantially triangular shaped rear fabric panel formed as a pocket having an open lower edge wherein said horizontal bar and said posterior frame portion form a frame for said rear fabric panel, said front fabric panel and said rear fabric panel including mated fasteners wherein said lower edge of said rear fabric panel is attachable to said front fabric panel.

7. The garment of claim 6, wherein said horizontal bar is removably attached to said loop in said posterior frame portion.

8. The garment of claim 1, wherein said front fabric panel includes apertures coincident with said loops in said anterior frame portion and said garment further includes ornaments removably attached to said loops through said apertures.

9. The garment of claim 1, wherein said ornaments are configured to be positioned against the skin of said wearer.

10. The garment of claim 1, wherein said frame is constructed from piano wire.

11. The garment of claim 1, wherein said frame is constructed from stainless steel spring wire.

12. An open-sided thong-type brief garment; comprising:

a frame constructed from resilient wire, said frame having an anterior frame portion and a posterior frame portion each formed from a single segment of wire wherein said anterior frame portion and posterior frame portion curve inwardly towards one another in a spring-biased arrangement;

said anterior frame portion configured in a symmetrical U-shape wherein said anterior portion is adapted to curve around the genital region of the wearer, said anterior frame portion having an arcuate base and two upwardly extending stems terminating in closed loops;

said posterior frame portion being attached to said arcuate base and configured to curve upwardly between the buttocks of the wearer, said posterior frame portion terminating in a closed loop adapted for tensioned engagement with the sacrum of the wearer; and a fabric covering on said frame, wherein said fabric covering includes a substantially triangular-shaped front fabric panel spanning said anterior frame portion, said fabric panel having left and right side edges which are each formed as a casing having an inside accessible through first and second openings, and each of said casings respectively including retractable elastic belts disposed therein, wherein said retractable belts each have a first end secured to said inside of said casing and a second end extendable outside the casing through one of said openings, wherein said second ends include mated fasteners wherein said belts can be securely attached to one another whereby the belts can encircle the waist of a wearer.

13.The garment of claim 12, further comprising a skirt garment having an upper edge adapted to fit on the waist of a wearer, said upper edge including an attachment means wherein said upper edge can be attached to said belts when said belts are fastened to one another.

14. The garment of claim 13, wherein said attachment means comprises mated strips of hook and loop fastening material.

15. The garment of claim 12, wherein said frame is constructed from piano wire.

16. The garment of claim 12, wherein said frame is constructed from stainless steel spring wire.

17. An open-sided thong-type brief garment; comprising:

a frame constructed from resilient wire, said frame having an anterior frame portion and a posterior frame portion each formed from a single segment of wire wherein said anterior frame portion and posterior frame portion curve inwardly towards one another in a spring-biased arrangement;

said anterior frame portion configured in a symmetrical U-shape wherein said anterior portion is adapted to curve around the genital region of the wearer, said anterior frame portion having an arcuate base and two upwardly extending stems terminating in closed loops;

said posterior frame portion being attached to said arcuate base and configured to curve upwardly between the buttocks of the wearer, said posterior frame portion terminating in a closed loop adapted for tensioned engagement with the sacrum of the wearer; and a fabric covering on said frame, wherein said fabric covering includes a substantially triangular-shaped front fabric panel spanning said anterior frame portion, said fabric panel having a top edge and left and right side edges, wherein said top edge is formed as a casing having an inside accessible through first and second openings at each of said left and right side edges, said casings respectively including first and second retractable elastic belts disposed therein, wherein said first and second retractable belts each have a first end secured in said inside of said casing and second ends respectively extendible through said first and second openings wherein said first and second belts can be withdrawn from said casing; said second ends each including a mated fastener wherein said belts can be securely attached to one another whereby the belts can encircle the waist of a wearer.

* * * * *